US005506378A

United States Patent [19]

Goldenberg

[11] Patent Number: 5,506,378

[45] Date of Patent: Apr. 9, 1996

[54] IMPACT RESISTANT SWITCH MECHANISM

[75] Inventor: Michael P. Goldenberg, Chapel Hill, N.C.

[73] Assignee: Ericsson Inc., Research Triangle Park, N.C.

[21] Appl. No.: 293,623

[22] Filed: Aug. 22, 1994

[51] Int. Cl.[6] ..... H01H 13/70

[52] U.S. Cl. ..... 200/345; 200/336; 200/564; 200/567; 200/292; 200/301; 200/302.1

[58] Field of Search ..... 200/345, 344, 200/336, 564, 293, 294, 295, 565, 567, 570, 571, 572, 520, 301, 302.1, 302.2, 302.3, 292

[56] References Cited

U.S. PATENT DOCUMENTS 2,978,549 4/1961 Krueger ..... 200/565
3,030,460 4/1962 Huetten et al. ..... 200/292
4,652,947 3/1987 Oka et al. ..... 200/292
4,778,953 10/1988 Kato ..... 200/302.1
5,276,299 1/1994 Marsh ..... 200/570

*Primary Examiner*—Henry J. Recla
*Assistant Examiner*—David J. Walczak
*Attorney, Agent, or Firm*—Charles L. Moore, Jr.

[57] ABSTRACT

An impact resistant switch mechanism is disclosed which includes a switch disposed within a housing of a device, such as a communication device or the like. The housing has an opening formed therein through which the switch may be operated from outside the housing. An extension of material extends from the housing about the housing opening, and a shaft extending through the extension of material and the housing opening is coupled at one end to the switch for operation thereof. A knob is attached to an opposite end of the shaft and is disposed over the housing extension. The knob is rotatable about the extension and will come into contact with the extension if a force is applied to the knob before transmission of the force into the switch, which could result in possible damage to the switch.

17 Claims, 3 Drawing Sheets

IMPACT RESISTANT SWITCH MECHANISM

BACKGROUND OF THE INVENTION

The present invention relates to switches and, more particularly, to an impact resistant rotary switch mechanism for use with a communications device or the like.

Communications devices, such as personal radios and the like, have historically had problems with rotary switch mechanisms having actuation knobs or the like positioned on the exterior of the radio for control of operation of the radio, such as volume control, channel selection, squelch control and the like. These switch mechanisms are prone to breakage from an impact to the external knob when the radio is dropped or bumped on a hard surface. The force of such an impact on the external knob may be transmitted to the actual electrical switch within the radio housing resulting in damage to the switch, such as bent shafts, broken solder joints, jammed internal contacts and the like.

SUMMARY OF THE INVENTION

It is, accordingly, a primary object of the present invention to provide a novel switch mechanism which is not subject to the foregoing disadvantages.

It is another object of the present invention to provide a novel switch mechanism which is impact resistant and can be easily incorporated into a communications device with no additional fasteners or minimal added parts which could add weight to the device.

In accordance with the present invention, an impact resistant switch mechanism includes a switch disposed within a housing. The housing has an opening formed therein through which the switch may be operated from outside the housing. An extension of material extends outwardly from the housing about the opening. A shaft extends through the housing extension and the housing opening and is coupled at one end to the switch for operation thereof. A knob, actuator or the like is attached to an opposite end of the shaft on the exterior of the housing and is disposed over the housing extension. The knob is rotatable about the extension and will come into contact with the extension if a force is applied to the knob before transmission of the force into the switch, resulting in possible damage to the switch.

In accordance with another embodiment of the present invention, the switch is mounted to a plate and a catch or lip is attached to or formed on an interior portion of the housing. A compressible gasket or the like is preferably disposed between the switch and the housing to bias the plate against the catch or lip and to provide a seal between the switch and the exterior of the housing within the housing opening.

These and other objects of the invention, together with features and advantages therefore, will become apparent from the following detailed specification when read with the accompanying drawings in which like reference numerals refer to like elements.

DETAILED DESCRIPTION OF THE PREFERRED EMBODIMENTS

Figure 1:
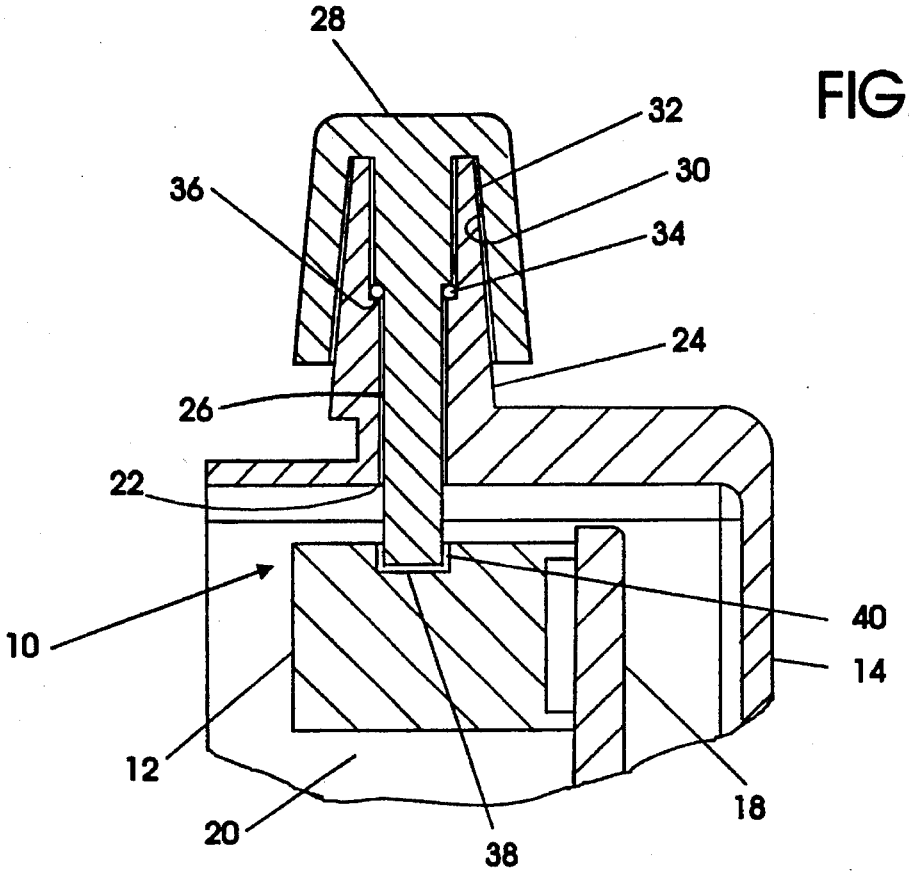
FIG. 1 is a cross-sectional view of a switch mechanism in accordance with the present invention.
Figure 2:
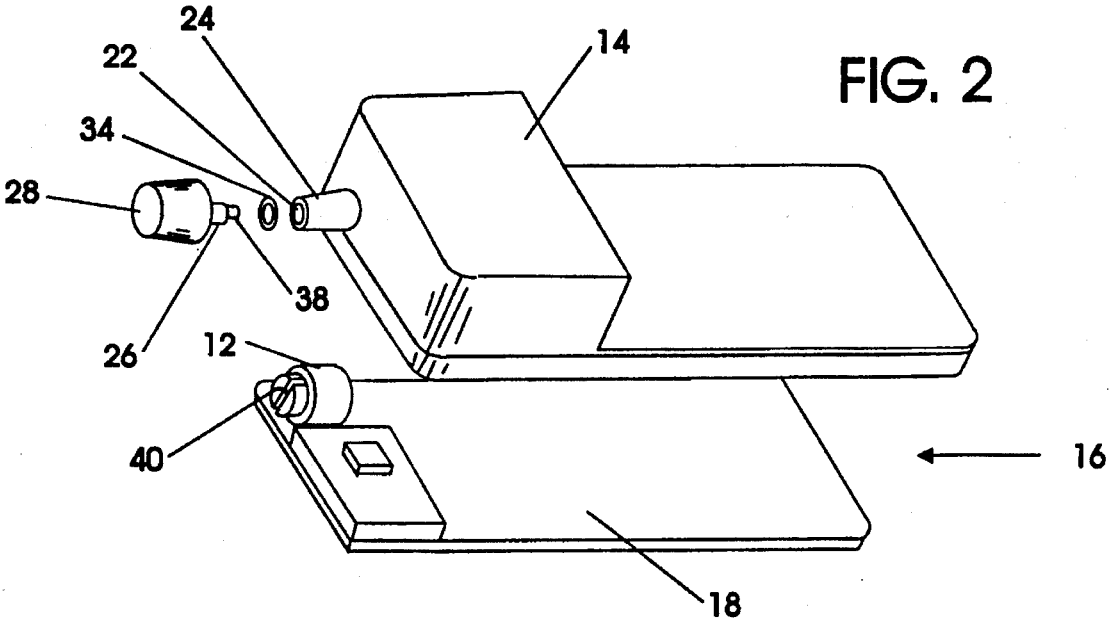
FIG. 2 is an exploded perspective view of a communications device illustrating how the switch mechanism of the present invention may be assembled.

Referring initially to FIGS. 1 and 2, in accordance with one embodiment of the present invention, the impact resistant switch mechanism, indicated generally by reference numeral 10, includes a switch 12, such as a variable resistance rotary type switch, an electronic multiple terminal rotary switch, both for use in a communications type device or the like. The switch 12 is disposed within a housing 14 of the communications device (indicated generally by reference numeral 16 in FIG. 2) or other apparatus usable in an environment where the switch mechanism 10 may be subjected to impact forces which could damage the switch 12. The switch 12 may be mounted to a printed circuit board (PCB) 18 which in turn is mounted within the interior 20-of the housing 14 or the switch 12 may be directly mounted to the interior 20 of the housing 14.

The housing 14 has an opening 22 formed therein through which the switch 12 may be operated from outside the housing 14. An extension 24 of material extends outwardly from the housing about the opening 22. The extension 24 may be formed by extruding the housing 14 outwardly to extend the housing opening 22 to form a substantially cylindrically shaped extension or tower 24 of material.

A shaft 26 extends through the tower or extension 24, through the opening 22 and is coupled to or engages the switch 12 for operation of the switch 12. A knob, handle or actuator 28 is attached to the shaft 26 and is disposed over the extension 24. The knob 28 is preferably substantially dome shaped to fit over and around the extension 24 and to rotate freely about the extension 24. In accordance with the present invention, the knob 28 has an interior portion 30 shaped to correspond substantially to the exterior shape of the tower 24 to cause the knob 28 to contact the tower or extension 24 if a force is applied to the knob 28 before transmission of the force via the shaft 24 into the switch 12 resulting in possible damage to the switch 12.

Referring to FIG. 2, the impact resistant switch mechanism 10 may be assembled with the communications device 16 by electrically and mechanically connecting the switch 12 to the main PCB 18 of the communications device 16 and then assembling the PCB 18 directly into the housing 14. With the shaft 26 being integrally formed or attached to the knob 28, the shaft 26 may be inserted through the housing opening 22 following the insertion of an o-ring 34. The o-ring 34 serves as a seal between the shaft 26 and the housing 14 and may reside on a circumferential ledge or lip 36 formed by a narrowing of the housing opening 22 at an intermediate location within the extension 24. The o-ring seal 34 prevents moisture, dirt or other contaminants from entering the interior 20 of the assembled housing 14.

The shaft 26 and the switch 12 may be coupled together by a tongue 38 and groove 40 arrangement or similar connection to permit operation of the switch 12 by rotation of the knob 28 and to permit easy assembly and disassembly of the communications device 16.

A plurality of such switch mechanisms 10 may be used depending upon the functions or features of the device to be controlled. For example, a personal communications radio may have at least two such switch mechanisms 10, one for controlling the volume of the radio and another for controlling the channel over which the radio will communicate.

Figure 3:
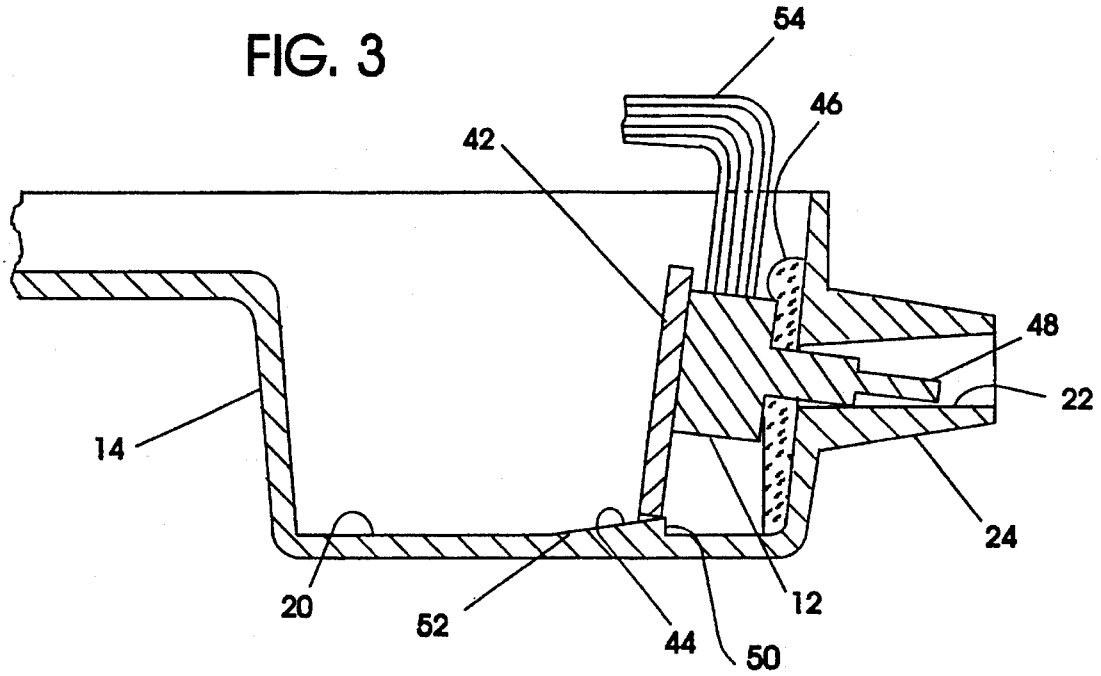
FIG. 3 is a cross-sectional view of a portion of a communications device illustrating assembly of a switch mechanism in accordance with another embodiment of the present invention.
Figure 4:
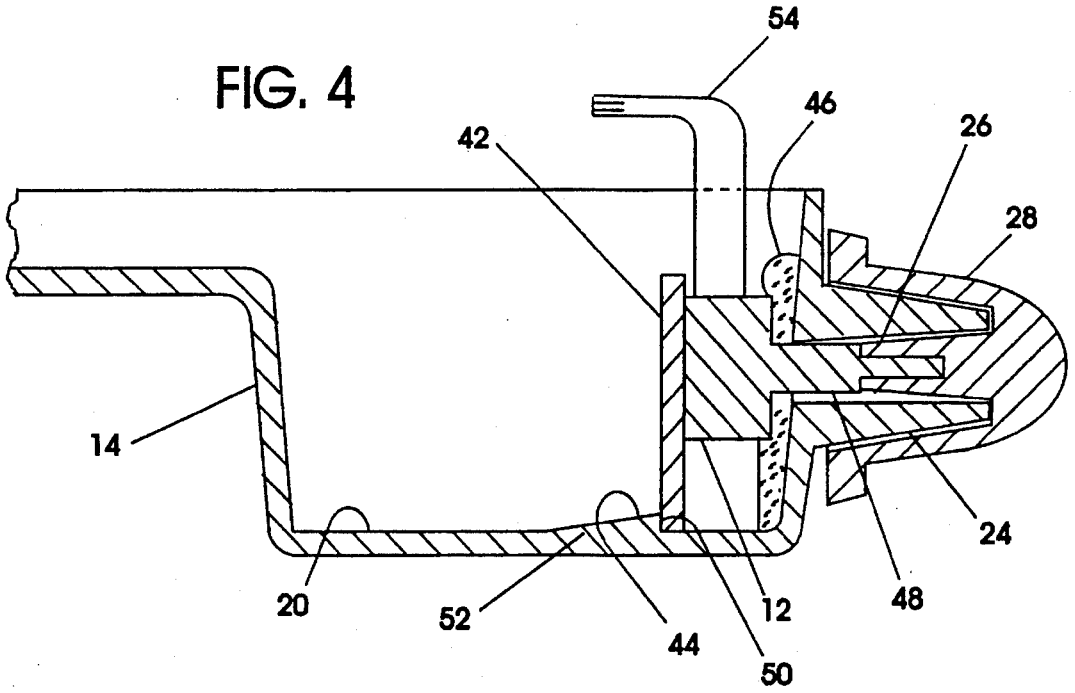
FIG. 4 is a cross-sectional view of a portion of a communications device illustrating the complete assembly of the switch mechanism in accordance with another embodiment of the present invention.

Referring now to FIGS. 3 and 4, in accordance with another embodiment of the present invention, a plate 42 is provided to which the switch 12 is attached or mounted. A catch 44 is formed or mounted to the interior portion 20 of the housing 14. A compressible gasket 46 may be disposed over the switch and plate with an operating shaft member 48 of the switch 12 extending through an opening formed in the gasket 46. The compressible gasket 46 may be made of an elastomeric material or similar compressible material.

The catch 44 may be substantially wedge-shaped with a lip 50 proximate to the housing opening 22 and a sloping portion 52 sloping downwardly away from the housing opening 22. The wedge-shaped catch 44 may be integrally formed as part of the interior 20 of the housing 14.

Figure 5:
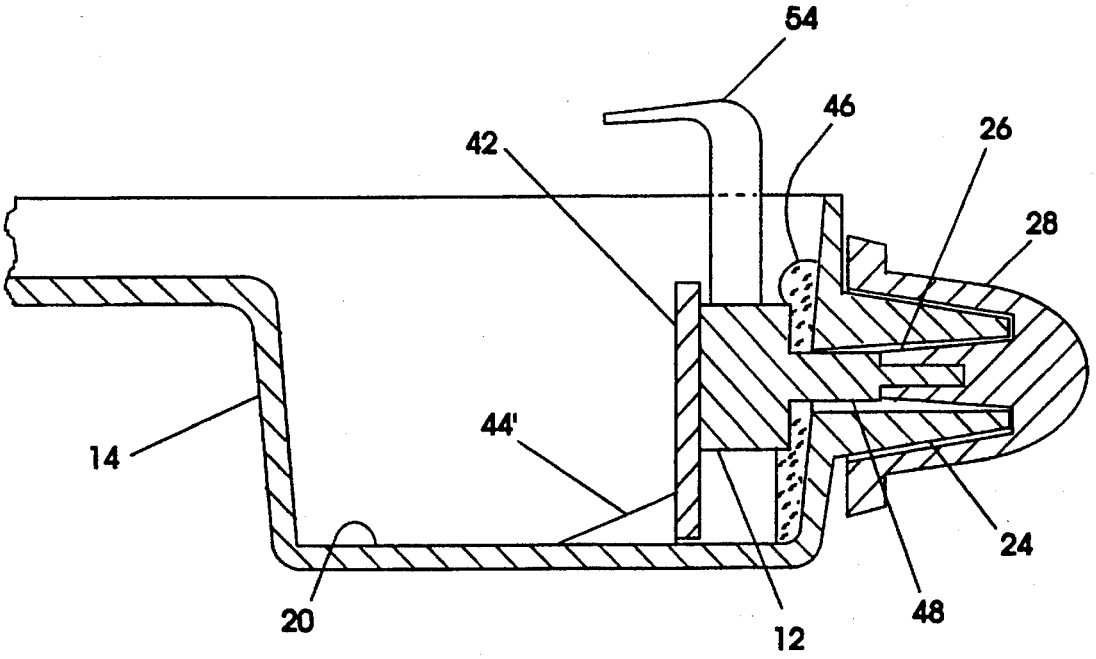
FIG. 5 is a cross-sectional view of a portion of a communications device illustrating the assembly of the switching mechanism in accordance with a further embodiment of the present invention.

In accordance with the present invention, the plate 42 is made from a substantially rigid material and the housing opening 22 has sufficient clearance relative to the operating shaft 48 of the switch 12 to permit the plate 42 to be slid up the ramp portion 52 of catch 44 and over the lip 50. The plate 42 will then abut the lip 50 and will be biased against the lip 50 by the compressible gasket 46. Alternatively, the plate 42 may be made from a resilient material which permits the plate 42 to deform slightly as it is slid over the catch 44 and then springs back to its original shape to abut the lip 50. Referring to FIG. 5, in accordance with a further embodiment of the present invention, the catch 44 may be a resilient member 44', such as a spring or the like, which will be depressed when the plate is pushed over the catch 44' toward the housing opening 22 and then will return to its original position after the plate 42 has passed over the catch 44' to retain the plate 42 in place.

The substantially dome-shaped knob 28 is then disposed over the extension 24 with the shaft 26 of the knob 28 engaging the shaft member 48 of the switch 12 to permit operation of the switch 12 by rotation of the knob 28 by a user. When the knob 28 is inserted over the extension 24 with the shaft 26 extending into the opening 22, the knob 28 substantially fills the clearance area in the housing opening 22 and thereby resists the ability of the plate 42 and switch 12 module from rotating out of place. As long as the knob 28 is in place, the switch 12 and plate 42 are retained in their position.

It should also be noted that the compressible gasket 46 also seals the interior 20 of the housing 14 from moisture, dirt or other contaminants as well as performing the function of biasing the plate 42 against the lip 50 of the catch 44 to further assist in maintaining the plate and switch module in their proper position. Accordingly, those skilled in the art will recognize that the compressible gasket 46 serves both as a seal and as a fastening means.

The switch 12 is electrically connected to other components of the device 16 by a flexible conductor strip 54.

The present invention, therefore, provides a novel switch mechanism which is highly resistant to impact forces in that the knob 28 will contact the housing extension 24 before the impact forces are transmitted to the switch 12, resulting in possible damage to the switch 12. The structure of the impact-resistant switch mechanism is simple with minimal additional components and may even result in a reduction of components, such as fasteners or the like, compared to prior art devices, resulting in further reduction in weight in the device which is important in the handheld portable communications device technology.

While the present invention has been described with respect to application in a communications type device, it will be recognized that the features and advantages of the present invention may also be used in other types of applications and devices where impact resistance is an important consideration. It will also be readily understood by those skilled in the art that the present invention is not limited to the specific embodiments described and illustrated herein. Different embodiments and adaptations besides those shown herein and described as well as many variations, modifications and equivalent arrangements will now be apparent or will be reasonably suggested by the foregoing specification and drawings, without departing from the substance or scope of the invention. While the present invention has been described herein in detail in relation to its preferred embodiments, it is to be understood that this disclosure is only illustrative and exemplary of the present invention and is made merely for purposes of providing a full and enabling disclosure of the invention. Accordingly, it is intended that the invention be limited only by the spirit and scope of the claims appended hereto.

What is claimed is:

1. An impact resistant switch mechanism, comprising:

a switch disposed within a housing, said housing having an opening therein through which said switch may be operated from outside said housing;

an extension of material having an internal bore, an upper surface and an exterior wall extending from said housing about said opening;

a shaft extending through said internal bore of said extension of material and said opening and coupled to said switch for operation thereof; and a knob attached to said shaft and having a portion disposed over said upper surface and having a portion depending below said upper surface and surrounding said extension of material, said knob being rotatable about said extension and having an interior portion for coming into contact with said extension if a force is applied to said knob before transmission of the force into said switch, resulting in possible damage to said switch.

2. The switch mechanism of claim 1, wherein said extension of material is substantially cylindrically shaped.

3. The switch mechanism of claim 1, further comprising an o-ring disposed about said shaft to provide a seal between said shaft and said housing and said extension.

4. The switch mechanism of claim 1, wherein said knob is substantially dome shaped to fit over and around said extension.

5. The switch mechanism of claim 1, wherein said shaft is coupled to said switch by a tongue and groove arrangement.

6. The switch mechanism of claim 1, wherein said knob has an interior portion shaped to correspond substantially to an exterior shape of said extension to cause said knob to contact said extension if a force is applied to said knob before transmission of the force into said switch.

7. The switch mechanism of claim 1, further comprising:

a plate to which said switch is mounted;

a catch attached to an interior portion of said housing;

a compressible gasket disposed between said switch and said housing, said plate being held in place in said housing when said plate is pushed over said catch to compress said gasket with said plate being biased against said catch by said gasket and when said knob is disposed over said housing extension with said shaft extending into said housing extension and engaging said switch.

8. The switch mechanism of claim 7, wherein said plate is made from a substantially rigid material and wherein said switch comprises an operating shaft member and said housing opening and interior portion of said housing extension have just enough clearance when said switch shaft member is inserted into said housing opening and extension to permit said plate to be pushed over said catch and captured in place by said catch.

9. The switch mechanism of claim 7, wherein said shaft of said knob closely fits said interior portion of said housing extension to assist said catch in retaining said switch in place.

10. The switch mechanism of claim 7, wherein said catch is a substantially wedge-shaped member formed on said housing with a lip proximate to said housing opening and sloping downwardly from said lip away from said housing opening.

11. The switch mechanism of claim 7, wherein said catch is a resilient member which depresses when said plate is pushed over it toward said housing opening and then springs back into its original position to retain said plate in place.

12. The switch mechanism of claim 7, wherein said plate is made from a resilient material to permit it to be deformed when slid over said catch.

13. An impact resistant rotary switch mechanism comprising:

a switch disposed within a housing, said housing having an opening therein and a plurality of sidewalls;

an extension of material extending from said housing about said opening;

a plate to which said switch is mounted;

a single catch attached to only one of said sidewalls of said housing for abutting at least a portion of by an edge of said plate such that said plate is only supported by said catch and said switch said catch having a structure to permit said plate to be slid over said catch during assembly of said switch mechanism;

a shaft extending through said housing extension and said opening and coupled to said switch for operation thereof; and a knob attached to said shaft for operation of said switch.

14. The switch mechanism of claim 13, wherein said knob has an interior portion shaped to correspond substantially to an exterior shape of said extension to cause said knob to contact said extension if a force is applied to said knob before transmission of the force into said switch.

15. The switch mechanism of claim 13, further comprising a compressible gasket, said gasket being disposed between said switch and an interior portion of said housing to bias said plate against said catch and to provide a seal between said switch and said housing within said housing opening.

16. The switch mechanism of claim 15, wherein said compressible gasket is an elastomeric pad.

17. An impact resistant rotary switch mechanism, comprising:

a switch disposed within a housing, said housing having an opening therein;

an extension of material extending from said housing about said opening;

a plate to which said switch is mounted;

a catch attached to an interior portion of said housing for abutting an edge of said plate;

a compressible gasket, said gasket being disposed between said switch and an interior portion of said housing to bias said plate against said catch and to provide a seal between said switch and said housing within said housing opening;

a shaft extending through said housing extension and said opening and coupled to said switch for operation thereof; and a knob attached to said shaft for operation of said switch.

* * * * *